US007014062B2

(12) United States Patent
Parris et al.

(10) Patent No.: US 7,014,062 B2
(45) Date of Patent: Mar. 21, 2006

(54) ACTIVITY WIPE DISPENSER AND MULTI-PACK ARRANGEMENT

(76) Inventors: Rex A. Parris, 92 Wilderness Camp Rd., White, GA (US) 30184; Donald R. Dodelin, 1501 Maplewood Ct., Woodstock, GA (US) 30189; Steven William Haynes, 209 Hart Cir., Dallas, GA (US) 30132; Ronald Steven Vangrov, 3297 Georgetown Bluff, Marietta, GA (US) 30066

( * ) Notice: Subject to any disclaimer, the term of this patent is extended or adjusted under 35 U.S.C. 154(b) by 0 days.

(21) Appl. No.: 10/807,707

(22) Filed: Mar. 24, 2004

(65) Prior Publication Data

US 2005/0211715 A1 Sep. 29, 2005

(51) Int. Cl.
*B65H 1/00* (2006.01)

(52) U.S. Cl. ..... 221/34; 221/100; 221/102

(58) Field of Classification Search ..... 221/34, 221/102, 98, 100, 63, 185; 206/145
See application file for complete search history.

(56) References Cited

U.S. PATENT DOCUMENTS

| | | | | |
|---|---|---|---|---|
| 2,841,276 | A * | 7/1958 | Schwimmer et al. | 206/449 |
| 3,393,688 | A * | 7/1968 | Saverino | 453/51 |
| 3,650,390 | A * | 3/1972 | Chung | 206/541 |
| 3,677,438 | A * | 7/1972 | Esposito | 221/63 |
| 3,785,484 | A * | 1/1974 | Cunningham | 206/427 |
| 4,328,907 | A * | 5/1982 | Beard | 221/63 |
| 4,756,411 | A * | 7/1988 | Garland | 206/223 |
| 4,903,860 | A * | 2/1990 | Leopoldi et al. | 221/4 |
| 4,919,302 | A * | 4/1990 | McPherson | 221/34 |
| 5,054,612 | A * | 10/1991 | Meyer, Jr. | 206/233 |
| 5,425,446 | A * | 6/1995 | Weaver et al. | 206/145 |
| 5,467,893 | A * | 11/1995 | Landis et al. | 221/34 |
| 5,577,635 | A * | 11/1996 | Block | 221/45 |
| 5,909,832 | A * | 6/1999 | French et al. | 224/547 |
| 6,053,320 | A * | 4/2000 | Kuethe | 206/462 |
| 6,279,775 | B1 * | 8/2001 | Parkes et al. | 221/63 |
| 6,321,933 | B1 * | 11/2001 | Vandenberg | 221/24 |
| 6,554,156 | B1 * | 4/2003 | Chong | 221/63 |
| 6,691,864 | B1 * | 2/2004 | Capo | 206/223 |
| 2003/0189059 | A1 * | 10/2003 | May et al. | 221/34 |

FOREIGN PATENT DOCUMENTS

| | | | |
|---|---|---|---|
| DE | 3915741 | A1 * | 11/1989 |
| JP | 1139378 | A * | 1/1989 |

* cited by examiner

*Primary Examiner*—David H. Bollinger

(57) ABSTRACT

This invention generally relates to an activity wipe dispenser and multi-pack arrangement for use during a variety of different activities; and, more particularly, to an activity wipe dispenser adapted for attachment to different articles and for storage of used wipes as well as to a multi-pack arrangement comprising a plurality of activity wipe dispensers each having different and complementary active components particularly useful in connection with different aspects of a specific activity.

8 Claims, 5 Drawing Sheets

ACTIVITY WIPE DISPENSER AND MULTI-PACK ARRANGEMENT

BACKGROUND OF THE INVENTION

1. Field of the Invention

This invention generally relates to an activity wipe dispenser and multi-pack arrangement for use during a variety of different activities; and, more particularly, to an activity wipe dispenser adapted for attachment to different articles and for storage of used wipes as well as to a multi-pack arrangement comprising a plurality of activity wipe dispensers each having different and complementary active components particularly useful in connection with different aspects of a specific activity.

2. Background of the Invention

Pre-moistened sheets, towelettes, or wet wipes, such as for cleaning hands and the like, are made from a porous sheet moistened with suitable wiping solutions which can include functional ingredients. For example, U.S. Pat. No. 4,904,524 to Yoh discloses such functional ingredients to include: sun screen, insect repellent, lubricating shaving lotion, as well as cleaning and waxing solutions for furniture. Thus, wet wipes can be used to clean surfaces, apply topical lotions and clean adult and baby skin to name a few uses. They are used during a variety of activities, particularly when access to washroom facilities or other facilities are not available, such as, for example, while traveling in an automobile; while engaged in sports activities (e.g. tennis, golf, baseball, etc.); or while participating in camping, hiking, picnicking and related activities.

However, typically, each different type of wet wipe is sold individually in dispenser which is not particularly adapted for use during the noted variety of different activities.

Dispensers for wet wipes typically comprise one of two general types of packaging. The first type packaging dispenses individual sheets from a stack of sheets and the other type of packaging dispenses sheets from a continuous roll of sheets having perforations which separate the individual wet wipes. Containers associated with the continuous roll type configuration, typically comprise a hollow, plastic cylinder dispenser. Such containers are commonly semi-rigid and manufactured from materials such as polyethylene and/or polypropylene. The container usually has a lid or cover that is attached by a hinge or is mated with the container by a threaded connection. It is also known to include a dispensing port which allows for the removal of a wipe without requiring complete removal of the lid. Typically the dispensing port is designed to create tension in the wipe as it is withdrawn so that the wipe separates from the roll at the perforations as it is pulled through the port. However, known packaging arrangements for wet wipes do not include an arrangement for storing used wet wipes, which is problematic when there are no disposal facilities close by.

In addition to the foregoing, it is known to provide a harness for hitching a wet wipe dispenser onto a toilet tissue roll holder, such as disclosed by U.S. Pat. No. 4,978,095 to Phillips, or to provide a special dispensing system for wet wipes that includes a handle for carrying the dispenser. However, typically wet wipe dispensers are not equipped to be attached to disparate articles, such a golf bag or tackle box, which would make it much easier to use the wet wipes during extracurricular activities such as at sports events or while engaging in sport related activities such as golf, tennis, boating camping, fishing or the like.

SUMMARY OF THE INVENTION

Accordingly, it is an object of the present invention to provide an activity wipe dispenser and multi-pack arrangement that overcomes the deficiencies of the prior art.

Yet another object of the present invention is to provide an activity wipe dispenser adapted for attachment to different articles and for storage of used wipes.

Still another object of the present invention is to provide a multi-pack arrangement of activity wipe dispensers wherein the wipes contained by each of the dispensers have different and complementary active components useful for a particular activity.

Still another object of the present invention is to provide an activity wipe dispenser which is easy to use during a variety of different activities.

Another object of the present invention is to provide an activity wipe dispenser that can be used in an environmentally friendly manner.

One important and advantageous feature of the present invention is that it does not required a special dedicated dispenser for each different activity for which the wet wipes are particularly adapted for use.

To accomplish these and other objects as well as advantageous features of the present invention, there is provided an activity wipe dispenser for dispensing wipes which, according to one embodiment thereof, comprises: a container for containing a plurality of wet wipes; a lid; a dispensing port though which a wet wipe is dispensed; an arrangement for storing used wet wipes; and means for attaching the container to disparate articles.

According to another aspect of the present invention, there is provided a multi-pack arrangement of activity wipe dispensers wherein each activity wipe dispenser contains wipes with a different and complementary active component particularly useful in connection with different aspects of a specific activity, each activity wipe dispenser having a disposal chamber for receiving used wipes. According to one embodiment of the multi-pack arrangement, each activity wipe dispenser further comprises: a container for containing a plurality of wipes, the container having a closed bottom, sides and an open top; a lid for closing the open top of the container; a dispensing port though wipes are dispensed; and attachment means for attaching the container to disparate articles.

DETAILED DESCRIPTION OF THE PREFERRED EMBODIMENT(S)

Figure 1:
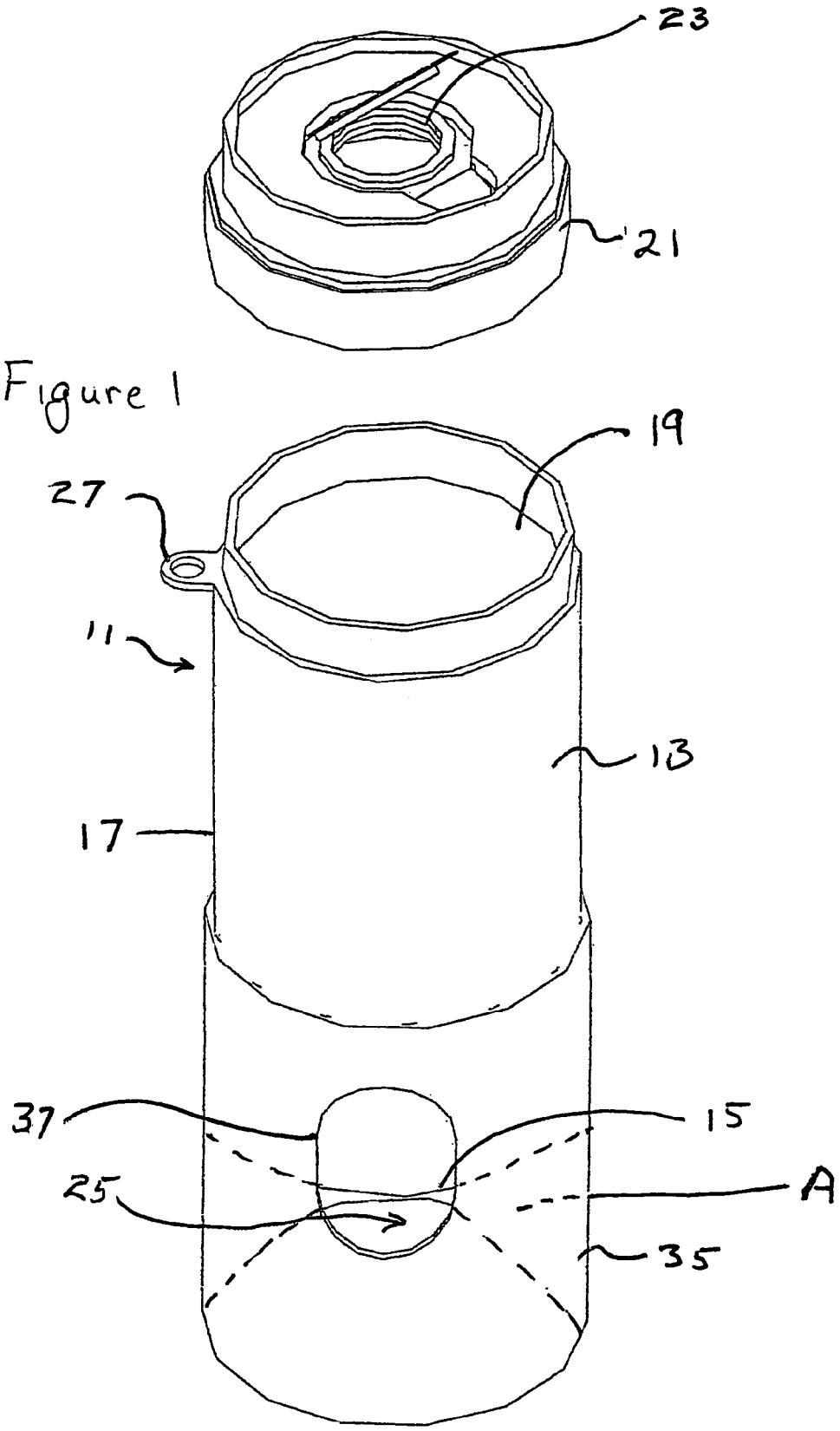
FIG. 1 is a front, perspective view of one embodiment of an activity wipe dispenser of the present invention.

Referring to Figure, one embodiment of an activity wipe dispenser for dispensing wipes is illustrated generally at 11. The dispenser 11 comprises a container 13 for containing a plurality of wipes 31 (best seen in FIG. 5), the container 13 having a closed bottom 15, sides 17 and an open top 19. A lid 21 is provided for closing the open top 19 of the container 13. Typically, the lid 21 has a dispensing port 23 though wipes are dispensed. The dispenser 11 is provided with a disposal chamber, generally indicated at 25, for receiving used wipes. Also shown in the embodiment of FIG. 1, the dispenser 11 is provided with an attachment means 27 for attaching the dispenser 11 to disparate articles, for example, items typically found when engaging in such activities such as boating, camping, sporting events, hunting, tennis, golf and fishing. Such items include, but are not limited to: golf bags, fishing equipment including tackle boxes, gym bags, hunting equipment, camping equipment, sporting equipment and the like.

Figure 5:
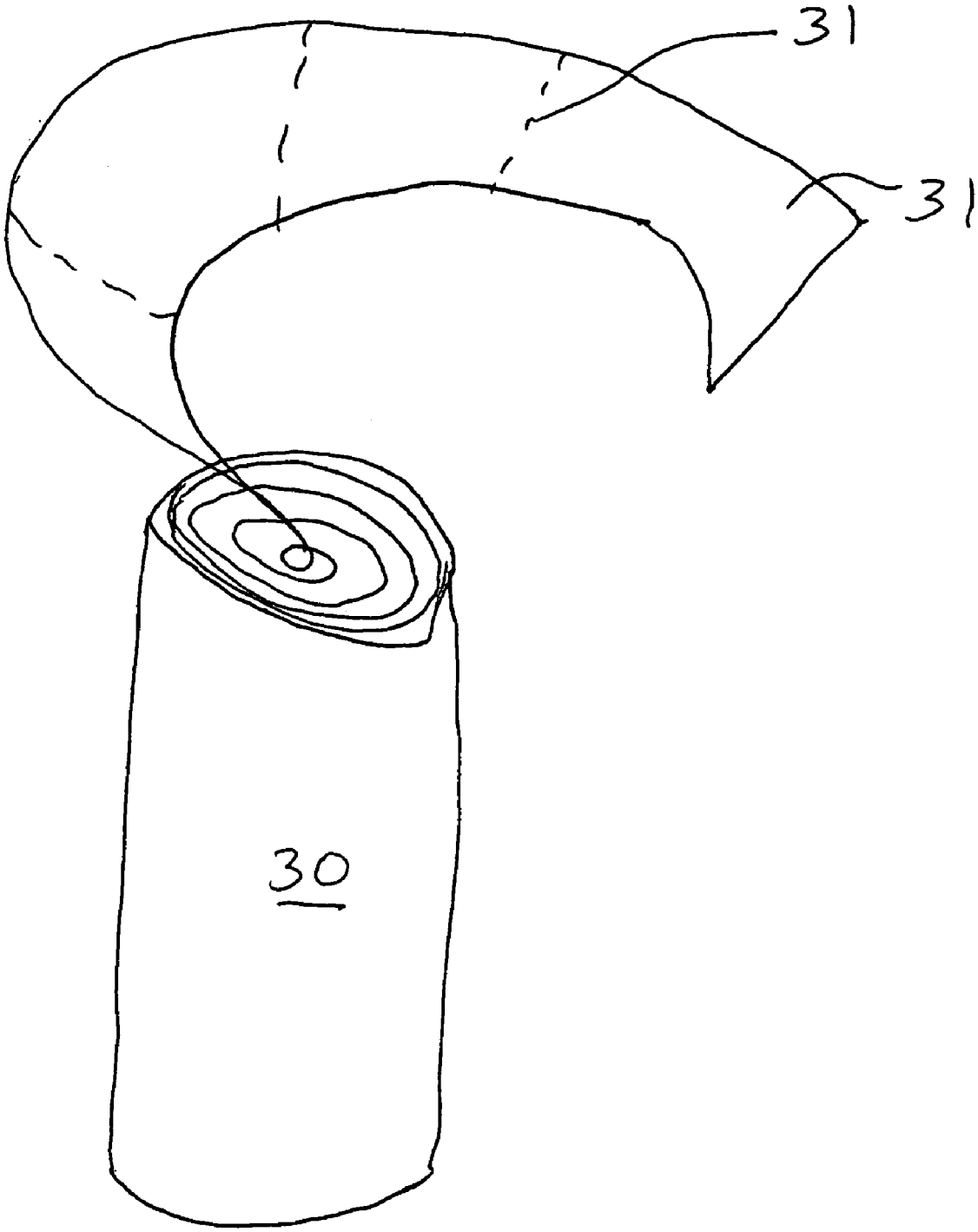
FIG. 5 is perspective view of the activity wipes dispensed by the dispenser of the present invention.

The container 13 comprises, for example, a hollow cylinder which is semi-rigid and manufactured from, for example, plastic materials. These plastic materials comprise at least one of polyethylene and polypropylene. Referring to FIG. 5, the wipes 31 comprise a continuous roll of sheet material 30 having perforations 33 which separate individual wipes 31 as best seen in FIG. 5.

In the embodiment illustrated by FIG. 1, the container 13 is a hollow cylinder and the disposal chamber 25 by a complementary telescoping hollow cylinder 35 which slides over the sides 17 of the container 13 at the closed bottom 15 of the container 13 to form an expandable disposal chamber space A. The telescoping cylinder 35 is provided with a disposal port 37 through which used wipes are placed into the disposal chamber space A.

Figure 2:
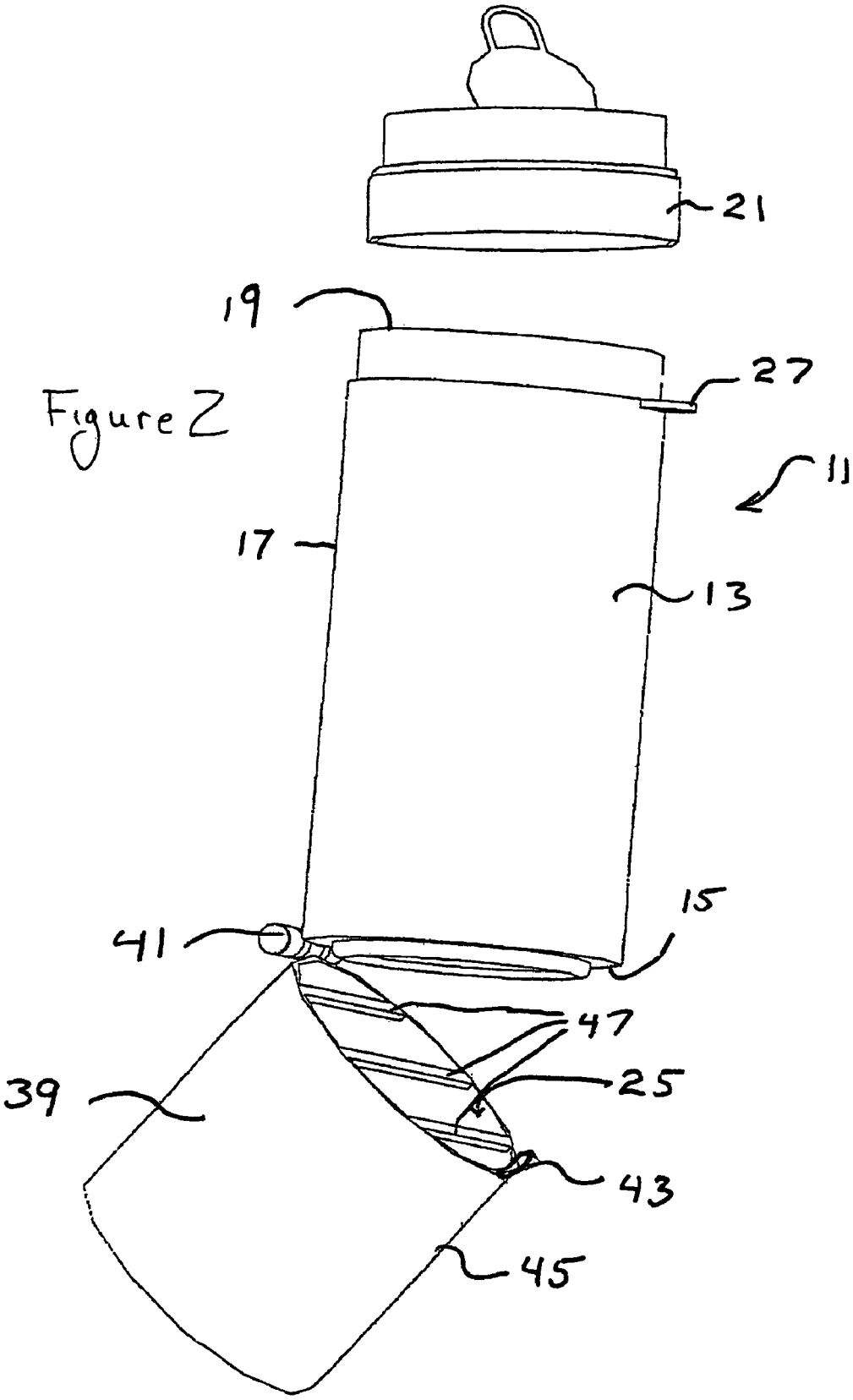
FIG. 2 is a front, perspective view of another embodiment of an activity wipe dispenser of the present invention.

Referring to FIG. 2, an alternative embodiment of the dispenser 11 is illustrated wherein the disposal chamber 25 is formed by a hollow cylinder 39 which is hinged at 41 to the closed bottom 15 of the container 13. Latching means 43 are provided for latching an unhinged side 45 of the cylinder 38 to the closed bottom 15 of the container 13. In the embodiment illustrated by FIG. 2, the hollow cylinder 39 has a diameter equal to that of the container 13 so that when the disposal chamber 25 is latched at the bottom 15 of the container 13, the container 13 forms a one continuous cylinder having substantially the same diameter along its entire length. The hollow cylinder 39 of the disposal chamber 25 illustrated by FIG. 2 has flexible and resilient, spaced ribs 47 that span a width of the cylinder 39, the flexible and resilient ribs 47 deflecting to receive and hold used wipes in the disposal chamber 25.

Figure 3:
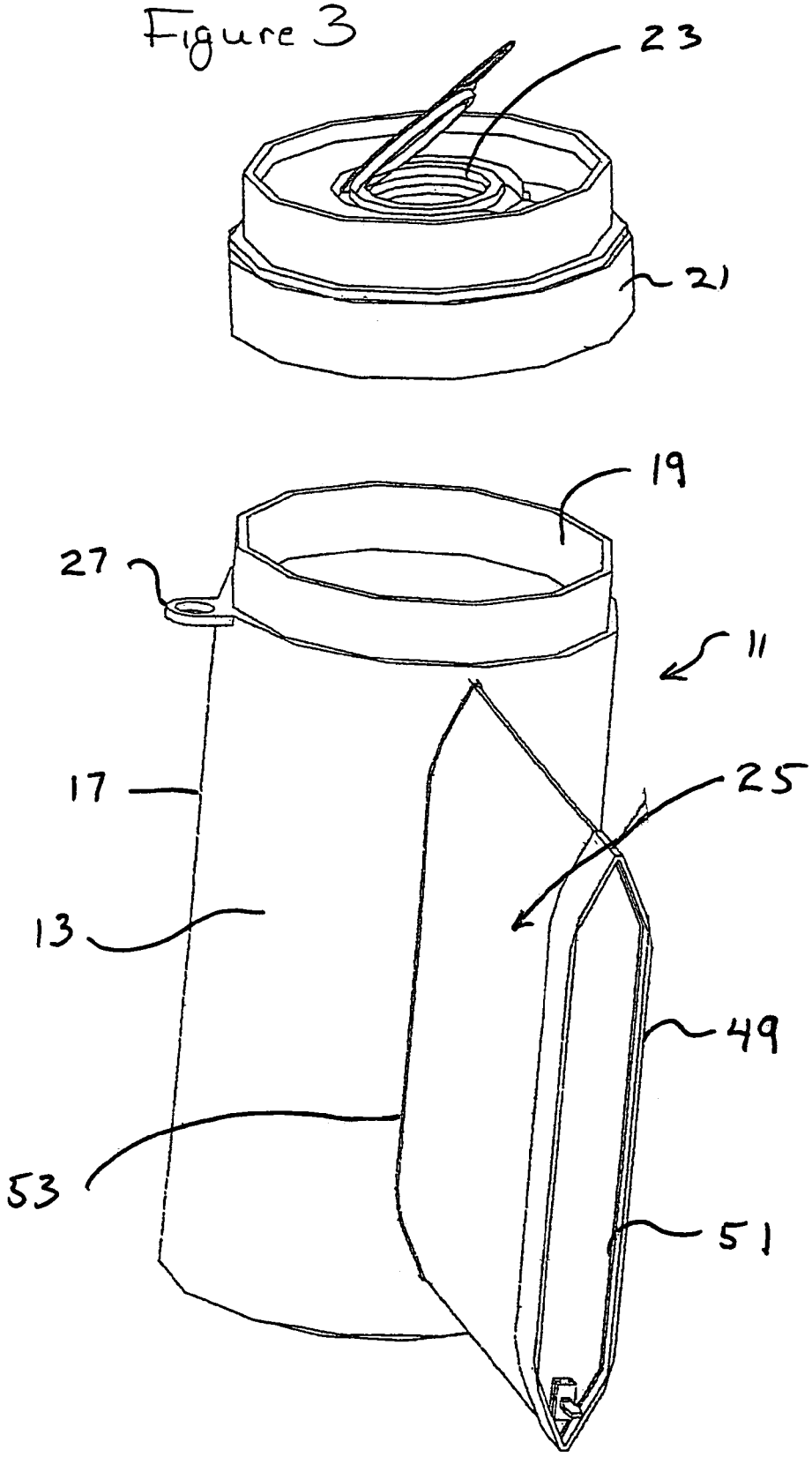
FIG. 3 is a front, perspective view of yet other embodiment of an activity wipe dispenser of the present invention.

Referring to FIG. 3, yet another embodiment of the activity wipe dispenser 11 of the present invention is illustrated wherein the disposal chamber 25 comprises a bag 49 having a zip-lock top 51, a bottom 53 of the bag 49 being attached to the side 17 of the container 13. In this arrangement, bag 49 is adapted to be wrapped around the sides 17 of the container 13 when displayed for sale or when not in use.

Figure 4:
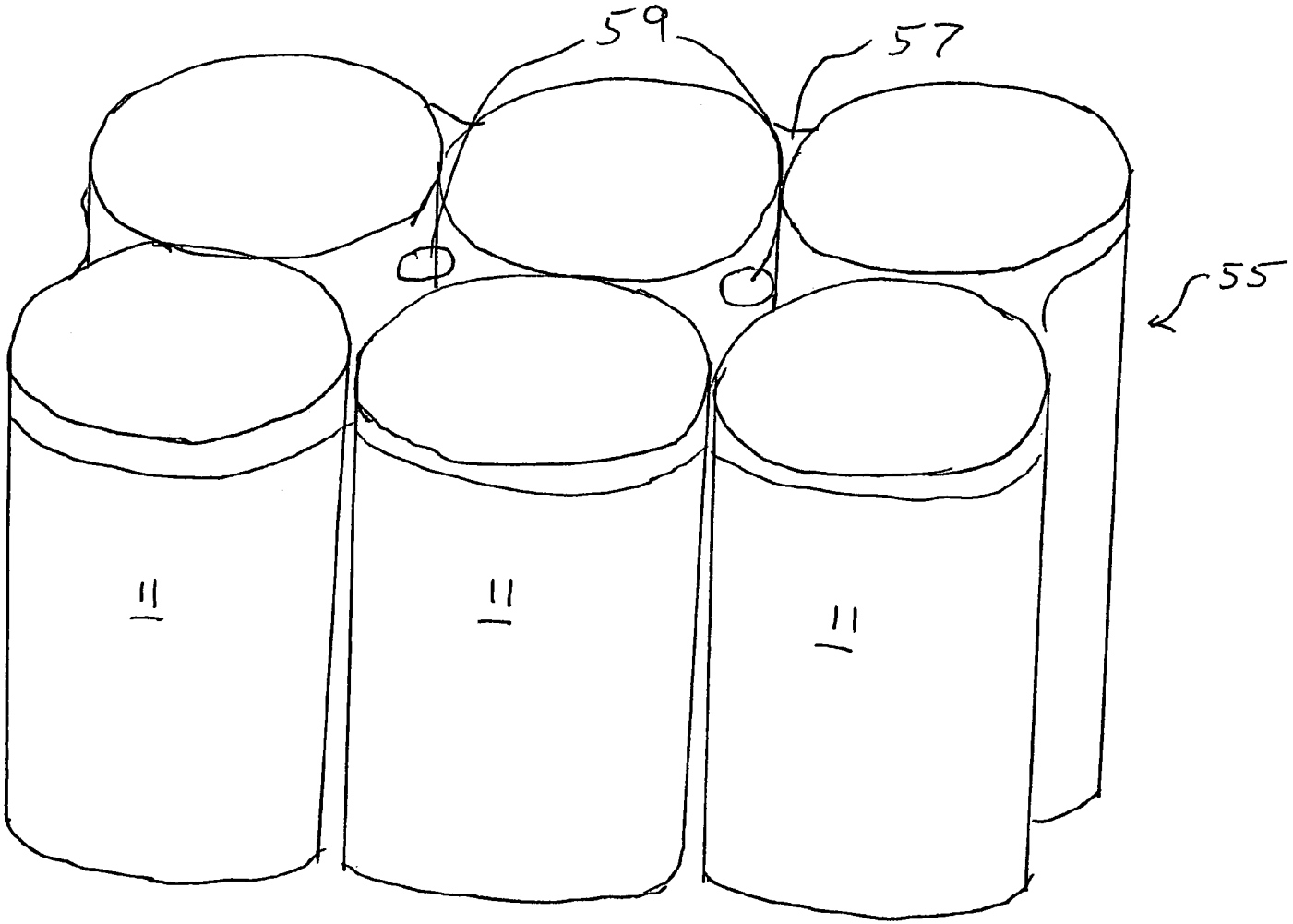
FIG. 4 is perspective view of one embodiment of the multi-pack arrangement of activity wipe dispensers in accordance with the present invention.

FIG. 4 illustrates one embodiment of a multi-pack arrangement, generally indicated at 55, of activity wipe dispensers 11 wherein each activity wipe dispenser 11 contains wipes with a different and complementary active component particularly useful in connection with different aspects of a specific activity, each activity wipe dispenser having a disposal chamber for receiving used wipes, such as those disclosed in FIGS. 1–3 of the present application. The dispensers 11 of the multi-pack arrangement 55 are held together in a group by a packaging retainer 57 similar to packaging retainers used to hold together a six pack can of drinks or the like as is well know in the packaging arts. The packaging retainer 57 is provided, for example, with finger holes 59 to permit easy carrying of the multi-pack arrangement 55.

According to various embodiments of the multi-pack arrangement 55, each activity wipe dispenser 11 comprises: a container for containing a plurality of wipes, the container having a closed bottom, sides and an open top; a lid for closing the open top of the container; a dispensing port though wipes are dispensed; and attachment means for attaching the container to disparate articles as shown in FIGS. 1 through 3 of the present application.

The specific activities for which the multi-pack arrangement is useful include, but are not limited to: boating, camping, sporting events, hunting, tennis, golf, auto care, home care, backpacking, cycling, skiing, child care, patient care, custodial work activities and fishing. The types of active ingredients include, but are not limited to: suntan lotion, sunscreen, insect repellent, deodorants, surface cleaning solutions, vinyl treatment solutions for extending the life of a vinyl surface, glass cleaning solutions, scented solutions (both fragrant as well as animal scents for use as lures during hunting or repellents during camping and/or backpacking), gun oil, shaving lotion, lubricants, surface treatment compounds such as paste wax, polish, furniture oil and the like, skin lotion, anti-bacterial soap, antibiotics, beauty aids, fungicides, and antiperspirants.

EXAMPLE 1

A multi-pack arrangement for hunting, packing and/or camping may include any combination of the following active ingredients: suntan lotion, sunscreen, insect repellent, deodorants, surface cleaning solutions, glass cleaning solutions, scented solutions such as animal scents for use as lures or repellents, gun oil, shaving lotion, lubricants, skin lotion, anti-bacterial soap, antibiotics, and antiperspirants to suppress the scent of the hunter.

EXAMPLE 2

A multi-pack arrangement for sporting activities such as golf and tennis may include any combination of the following active ingredients: suntan lotion, sunscreen, insect repellent, deodorants, surface cleaning solutions, skin lotion, anti-bacterial soap, antibiotics, and antiperspirants,

EXAMPLE 3

A multi-pack arrangement for fishing and boating activities may include any combination of the following active ingredients: suntan lotion, sunscreen, insect repellent, deodorants, surface cleaning solutions, vinyl treatment solutions for extending the life of a vinyl surface, glass cleaning solutions, scented solutions shaving lotion, lubricants, surface treatment compounds such as paste wax, polish, furniture oil and the like, skin lotion, anti-bacterial soap, antibiotics, fungicides, and antiperspirants,

EXAMPLE 4

A multi-pack arrangement for home and/or automobile care may include any combination of the following active ingredients: deodorants, surface cleaning solutions, vinyl treatment solutions for extending the life of a vinyl surface, glass cleaning solutions, fragrant scented solutions, surface treatment compounds such as paste wax, polish, furniture oil and the like, anti-bacterial soap, fungicides, and antiperspirants,

EXAMPLE 5

A multi-pack arrangement for child care, patient care, or personal care may include any combination of the following active ingredients: suntan lotion, sunscreen, insect repellent, deodorants, surface cleaning solutions, scented solutions, shaving lotion, skin lotion, anti-bacterial soap, antibiotics, beauty aids, fungicides, and antiperspirants, Although the present invention has been described in terms of specific exemplary embodiments, it will be appreciated that various modifications and alterations might be made by those skilled in the art without departing from the spirit and scope of the invention as specified in the following claims.

What is claimed is:

1. An activity wipe dispenser for dispensing wipes, the dispenser comprising:

a container for containing a plurality of wipes, the container having a closed bottom, sides and an open top;

a lid for closing the open top of the container; and a disposal chamber for receiving used wipes wherein the wipes comprise a continuous roll of sheet material having perforations which separate individual wipes; and wherein the container is a hollow cylinder and the disposal chamber comprises a hollow cylinder hinged to the closed bottom of the container and having latching means for latching an unhinged side of the cylinder at the closed bottom of the container.

2. An activity wipe dispenser according to claim 1, wherein the cylinder is semi-rigid and manufactured from plastic materials.

3. An activity wipe dispenser according to claim 2, wherein the plastic materials include at least one of polyethylene and polypropylene.

4. An activity wipe dispenser according to claim 1, wherein the hollow cylinder of the disposal chamber has flexible and resilient, spaced ribs that span a width of the cylinder, the flexible and resilient ribs deflecting to receive and hold used wipes in the disposal chamber.

5. A multi-pack arrangement of activity wipe dispensers:

wherein each activity wipe dispenser contains wipes with a different and complementary active component particularly useful in connection with different aspects of a specific activity, each activity wipe dispenser having a disposal chamber for receiving used wipes;

wherein each activity wipe dispenser further comprises:

a container for containing a plurality of wipes, the container having a closed bottom, sides and an open top;

a lid for closing the open top of the container; and attachment means for attaching the container to disparate articles; and wherein the container is a hollow cylinder and the disposal chamber comprises a hollow cylinder hinged to the closed bottom of the container and having latching means for latching an unhinged side of the cylinder at the closed bottom of the container.

6. A multi-pack arrangement according to claim 5, wherein the hollow cylinder of the disposal chamber has flexible and resilient, spaced ribs that span a width of the cylinder, the flexible and resilient ribs deflecting to receive and hold used wipes in the disposal chamber.

7. A multi-pack arrangement according to claim 5, wherein the specific activity comprises one of: boating, camping, sporting events, hunting, tennis, golf, auto care, home care, backpacking, cycling, skiing, child care, patient care, custodial work activities and fishing.

8. A multi-pack arrangement according to claim 7, wherein the active ingredients comprise two or more of the following: suntan lotion, sunscreen, insect repellent, deodorants, surface cleaning solutions, vinyl treatment solutions for extending the life of a vinyl surface, glass cleaning solutions, scented solutions, gun oil, shaving lotion, lubricants, paste wax, polish, furniture oil, skin lotion, anti-bacterial soap, antibiotics, beauty aids, fungicides, and antiperspirants.

* * * * *